US008851934B2

(12) United States Patent
McAlonis et al.

(10) Patent No.: US 8,851,934 B2
(45) Date of Patent: Oct. 7, 2014

(54) ELECTRICAL MODULE HOUSING

(75) Inventors: Matthew Richard McAlonis, Elizabethtown, PA (US); Chong Hun Yi, Mechanicsburg, PA (US); Albert Tsang, Harrisburg, PA (US); Dustin Carson Belack, Hummelstown, PA (US); Kevin Michael Thackston, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 87 days.

(21) Appl. No.: 13/424,595

(22) Filed: Mar. 20, 2012

(65) Prior Publication Data

US 2013/0252477 A1 Sep. 26, 2013

(51) Int. Cl.
*H01R 13/64* (2006.01)

(52) U.S. Cl.
USPC ..... 439/680

(58) Field of Classification Search
USPC ..... 439/680, 455, 567, 378, 372, 607.14, 439/352, 374
See application file for complete search history.

(56) References Cited

U.S. PATENT DOCUMENTS

| | | | | |
|---|---|---|---|---|
| 4,159,862 | A | 7/1979 | Funck et al. | |
| 4,558,916 | A * | 12/1985 | Hehl | 439/467 |
| 4,869,677 | A | 9/1989 | Johnson et al. | |
| 5,073,127 | A * | 12/1991 | Daly et al. | 439/473 |
| 5,181,855 | A | 1/1993 | Mosquera et al. | |
| 5,667,411 | A * | 9/1997 | O'Sullivan et al. | 439/701 |
| 5,788,528 | A * | 8/1998 | Orr et al. | 439/358 |
| 6,751,392 | B1 * | 6/2004 | Szilagyi et al. | 385/134 |
| 7,108,555 | B2 * | 9/2006 | Mao et al. | 439/607.01 |
| 7,186,121 | B1 | 3/2007 | Costello et al. | |
| 7,824,210 | B2 * | 11/2010 | Oka et al. | 439/372 |
| 7,892,045 | B2 * | 2/2011 | Ratzlaff et al. | 439/701 |
| 7,896,683 | B1 * | 3/2011 | Ratzlaff et al. | 439/374 |
| 7,997,938 | B2 * | 8/2011 | Costello et al. | 439/660 |
| 8,052,481 | B2 * | 11/2011 | Azad et al. | 439/676 |
| 8,425,250 | B2 * | 4/2013 | Kagotani | 439/374 |
| 2011/0256753 | A1 | 10/2011 | Gulla | |

FOREIGN PATENT DOCUMENTS

| | | |
|---|---|---|
| EP | 0 374 307 A1 | 6/1990 |
| GB | 2 185 160 A | 7/1987 |
| WO | 0062380 A1 | 10/2000 |

OTHER PUBLICATIONS

European Search Report, Mail Date, Nov. 6, 2013, EP 13 15 9120, Application No. 13159120.8-1801/2642615.

* cited by examiner

*Primary Examiner* — Jean F Duverne

(57) ABSTRACT

An assembly is configured to retain a plurality of electrical modules and mate with a shroud having a plurality of connecting interfaces configured to mate with the plurality of electrical modules. The assembly includes a frame having at least one shroud-securing bracket and at least one bay configured to retain at least one of the plurality of electrical modules, and at least one keying insert retained within at least one insert passage of the at least one shroud-securing bracket. The at least one keying insert includes at least one adjustable keying feature that is configured to be adjusted to different positions in order to accommodate a reciprocal alignment post of the shroud.

9 Claims, 10 Drawing Sheets

ELECTRICAL MODULE HOUSING

BACKGROUND OF THE INVENTION

The subject matter herein relates generally to electrical connector assemblies.

Due to their favorable electrical characteristics, coaxial cables and connectors have grown in popularity for interconnecting electronic devices and peripheral systems. The connectors include an inner conductor coaxially disposed within an outer conductor, with a dielectric material separating the inner and outer conductors. A typical application utilizing coaxial cable connectors is a radio-frequency (RF) application having RF connectors designed to work at radio frequencies in the UHF and/or VHF range.

Typically, one or more connectors are mounted to a circuit board of an electronic device at an input/output port of the device and extend through an exterior housing of the device for connection with a coaxial cable connector. Some systems include a plurality of connectors held in a common housing. One particular example of a system that uses multiple connectors is a backplane module having a plurality of board mounted connectors with a separate mating assembly for mating with a daughtercard module. The mating assembly includes a housing holding a plurality of coaxial cable connectors, which are connected to the board mounted connectors by a cable assembly having lead end connectors individually terminated to corresponding board mounted connectors. The daughtercard module is mated with the mating assembly.

Typical backplane systems using RF connectors are not without disadvantages. For instance, each of the lead end connectors are typically individually and separately mated with the board connectors, which is time consuming and increases the cost of assembly. Additionally, the spacing between the housing of the mating assembly and the board connectors may be very small, such as less than one inch, making the assembly process difficult and time consuming. Manipulating a large number of connections for mating also increases time and complexity.

Some module housings include keying inserts that are configured to receive reciprocal pins of a mating shroud. The pins may include a generally cylindrical shaft, but with a flat surface portion. The pins are configured to mate into the keying inserts of the module housing such that the flat surface portions are aligned with and mated into reciprocal flat features of the keying inserts. In this manner, the keying inserts ensure that the mating shroud is properly aligned and mated with the module housing. However, typical keying inserts do not provide a positive electrical conductive path for electrostatic discharge. Thus, a sudden electrical surge may pass from the pins and into the module housing, which may damage electrical modules within the module housing. Additionally, typical module housings include keying inserts that are front-loaded and require separate and distinct retaining clips to secure the keying inserts to the module housings, thereby increasing the time and complexity of the manufacturing process.

BRIEF DESCRIPTION OF THE INVENTION

Certain embodiments provide an assembly configured to retain a plurality of electrical modules. The assembly is configured to mate with a shroud having a plurality of connecting interfaces configured to mate with the plurality of electrical modules. The assembly includes a frame having at least one shroud-securing bracket and at least one bay configured to retain at least one of the plurality of electrical modules. The assembly also includes at least one keying insert retained within at least one insert passage of the at least one shroud-securing bracket. The keying insert(s) includes at least one adjustable keying feature that is configured to be adjusted to different positions in order to accommodate a reciprocal alignment post of the shroud.

The keying insert(s) may be configured to be adjusted by rotating the keying insert(s) relative to the shroud-securing bracket. The keying insert(s) may include an outer body having a cylindrical internal passage connected to the adjustable keying feature(s). The adjustable keying feature(s) may include a flattened internal passage wall. The outer body may be an octagonal outer body.

The assembly may also include at least one fastener that secures the keying insert(s) to the shroud-securing bracket(s). Alternatively, the keying insert(s) may be snapably secured within the insert passage(s). The keying insert(s) may include a tube having deflectable segments configured to snapably secure within the insert passage(s).

The assembly may also include at least one grounding member secured within the shroud-securing bracket(s). The grounding member(s) may be configured to direct electrostatic discharge from the shroud to ground. The grounding member(s) may include opposed annular ends integrally connected to louvered vanes. The louvered vanes may curve inwardly toward a center of the at least one grounding member. The grounding member(s) may be within the keying insert(s). The grounding member(s) may be separate and distinct from the keying insert(s).

Certain embodiments provide an assembly configured to retain a plurality of electrical modules. The assembly is configured to mate with a shroud having a plurality of connecting interfaces configured to mate with the plurality of electrical modules. The assembly may include a frame having first and second shroud-securing brackets and a plurality of bays configured to retain the plurality of electrical modules. The first and second securing brackets may be located at opposite ends of the frame.

The assembly may also include first and second keying inserts retained within first and second insert passages, respectively, of the first and second shroud-securing brackets, respectively. The first and second keying inserts may include first and second outer bodies, respectively, having first and second cylindrical internal passages, respectively, connected to first and second adjustable keying features, respectively. The first and second adjustable keying features may be configured to be adjusted to different positions in order to accommodate reciprocal alignment posts of the shroud. The first and second keying inserts may be configured to be adjusted independently of one another. Each of the first and second keying inserts may be configured to be adjusted by rotating the first and second keying inserts relative to the first and second shroud-securing brackets, respectively.

Each of the first and second adjustable keying features may include a flattened internal passage wall. Each of the first and second outer bodies may include an octagonal outer body.

The assembly may also include fasteners that secure the first and second keying inserts to the first and shroud-securing brackets, respectively. Alternatively, each of the first and second keying inserts may include a tube having deflectable segments configured to snapably secure within the first and second insert passages.

The assembly may also include first and second grounding members secured within the first and second shroud-securing brackets, respectively. The first and second grounding members may be configured to direct electrostatic discharge from the shroud to ground. Each of the first and second grounding members may include opposed annular ends integrally connected to louvered vanes. The first and second grounding members may be within the first and second keying inserts, respectively.

DETAILED DESCRIPTION OF THE INVENTION

Figure 1:
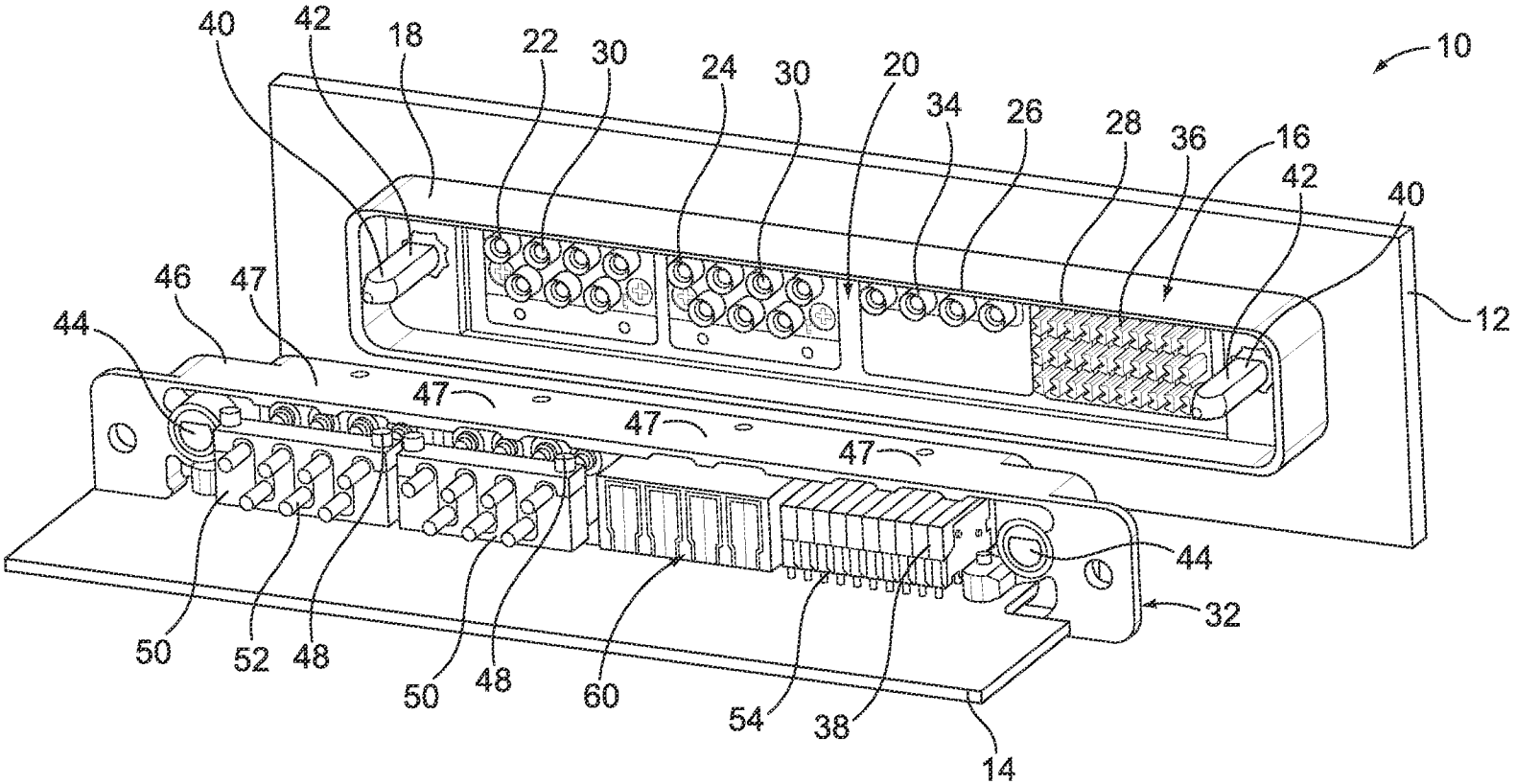
FIG. 1 illustrates a front isometric view of a disconnected electrical connector system, according to an embodiment.

FIG. 1 illustrates a front isometric view of a disconnected electrical connector system 10, according to an embodiment. The electrical connector system 10 may utilize coaxial cables and coaxial connectors for interconnecting electronic devices and peripheral systems. The electrical connector system 10 may be used to electrically connect a backplane or printed circuit board (PCB) 12 to a daughtercard or PCB 14.

A shroud, frame, base, or the like 16 is secured to the backplane 12. The shroud 16 includes a circumferential upstanding wall 18 defining an internal cavity 20. A plurality of connecting interfaces 22, 24, 26, and 28 are contained within the internal cavity 20. The connecting interfaces 22 and 24 may include a plurality of backplane contacts 30 configured to mate with electrical modules of a module shell, housing, assembly, or the like 32. Similarly, the connecting interface 26 may include a plurality of backplane contacts 34 configured to mate with RF connecting interfaces of the module shell 32. The connecting interface 28 may include a plurality of digital contacts 36 configured to mate with reciprocal digital contacts 38 secured to the module shell 32.

Alignment posts 40 are positioned at opposite ends of the internal cavity 20 and extend outwardly from the shroud 16. Each alignment post 40 may include a keying feature, such as a flattened area or surface 42 configured to ensure proper alignment with reciprocal apertures 44 of the module shell 32. That is, the alignment posts 40 and the reciprocal apertures 44 cooperate to ensure that the shroud 16 and the module shell 32 mate in a proper orientation with respect to one another.

The module shell 32 is secured to the daughtercard 14 and includes a plug housing 46 configured to mate into the internal cavity 20 of the shroud 16. The module shell 32 includes a plurality of compartments or bays 47 configured to receive and retain a plurality of modules. As shown in FIG. 1, the module shell 32 may include four bays. However, the module shell 32 may include more or less bays 47 than those shown in FIG. 1.

The module shell 32 may include a plurality of cable-connecting modules 48 configured to mate with the connecting interfaces 22 and 24. The cable-connecting modules 48 may be RF cable-connecting modules that include strain-relief features or brackets 50 securing RF coaxial cables 52, such as shown and described in U.S. application Ser. No. 12/939,862, entitled "RF Module," filed on Nov. 4, 2010, which is hereby incorporated by reference in its entirety.

The module shell 32 may also include a digital module 54 having the plurality of digital contacts 38 configured to mate with the digital contacts 36 within the internal cavity 20 of the shroud 16.

The module shell 32 may also include an RF module 60 configured to mate with the backplane contacts 34 of the connecting interface 26 of the shroud 16. While the system 10 is shown with a plurality of modules, the system 10 may be configured such that the bays 47 accommodate a wide variety of modules. For example, each bay 47 may retain an RF module 60 that is configured to mate with a reciprocal connecting interface of the shroud 16. Optionally, each bay 47 may retain a cable-retaining module 48, digital module 54, or any combination of such modules and/or RF modules 60.

The RF module 60, for example, is usable with any system that interconnects coaxial connectors and/or coaxial cables. The RF module 60 is particularly useful in systems that interconnect multiple coaxial connectors simultaneously. The electrical connector system 10 may be used within a rugged environment, such as in a military or aeronautical application in which the components of the electrical connector system 10 may be subject to vibration and/or shock.

Figure 2:
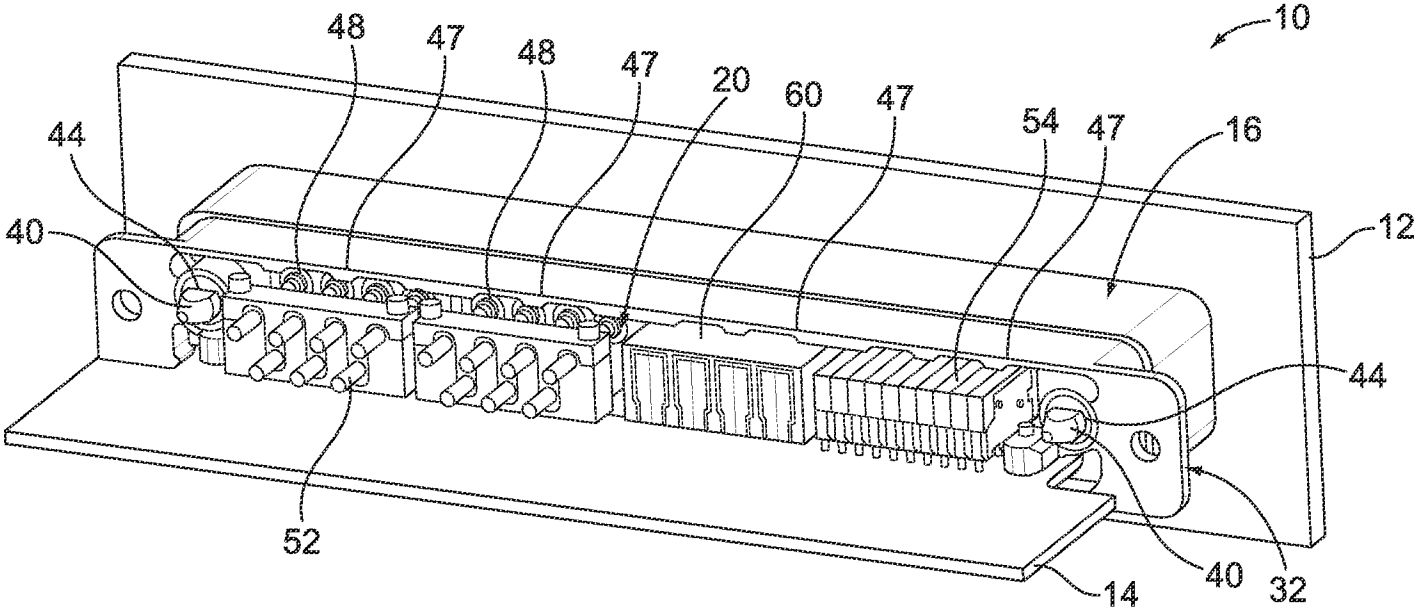
FIG. 2 illustrates a front isometric view of an electrical connector system, according to an embodiment.

FIG. 2 illustrates a front isometric view of the electrical connector system 10, according to an embodiment. In order to connect the shroud 16 and the module shell 32, the alignment posts 40 are aligned with the reciprocal apertures 44 of the module shell 32, thereby ensuring proper mating alignment and orientation. That is, the flattened surfaces 42 (shown in FIG. 1) of the alignment posts 40 are aligned with reciprocal flat wall portions of the apertures 44. The module shell 32 is then moved into the internal cavity of the shroud 16. Distal ends of the alignment posts 40 extend through the apertures 44, and the RF module 60, for example, mechanically and electrically mates with the backplane contacts 34 (shown in FIG. 1) of the reciprocal interface 26 (shown in FIG. 1). The other modules are similarly aligned and mated with their reciprocal interfaces within the internal cavity 20 of the shroud 16. In this manner, the backplane 12 is able to electrically communicate with the daughtercard 14.

Figure 3:
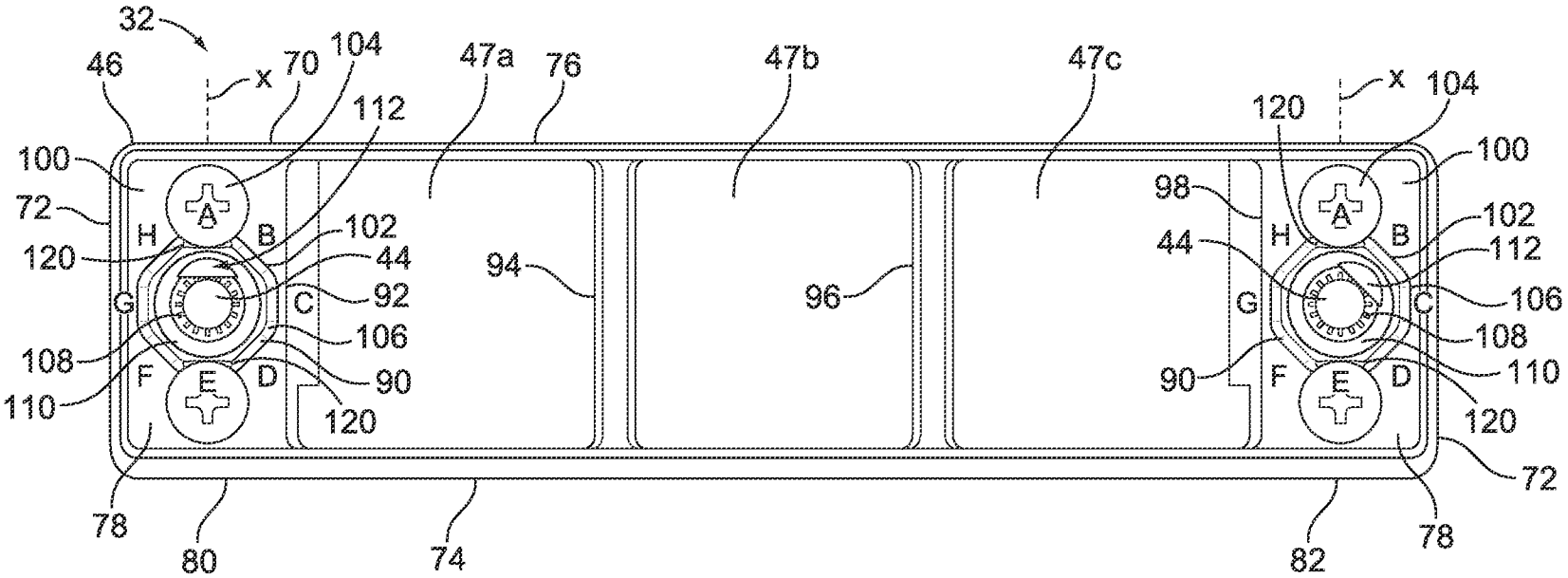
FIG. 3 illustrates a front view of a module shell, according to an embodiment.

FIG. 3 illustrates a front view of the module shell 32, according to an embodiment. As noted above, the module shell 32 includes the plug housing 46, which includes a frame 70 having lateral walls 72 integrally connected to a base 74, and a top wall 76. Shroud-securing brackets 78 are located at opposite ends 80 and 82 of the frame 70. Each shroud-securing bracket 78 includes a keying insert 90 that defines an aperture 44. While the shroud-securing brackets 78 are shown at opposite ends 80 and 82 of the frame 70, the shroud-securing brackets 78 may be alternatively positioned at other locations within the frame 70. For example, the shroud-securing brackets 78 may be located proximate the center of the frame 70. Additionally, more or less than two shroud-securing brackets 78 may be positioned within the frame 70.

As shown in FIG. 3, the bays 47 are located between the shroud-securing brackets 78. The bay 47*a* is defined by an internal wall 92 of the shroud-securing bracket 78 at the end 80, the top wall 76, the base 74, and a vertical beam 94 extending from the top wall 76 to the base 74. The bay 47*b* is defined by the vertical beam 94, the top wall 76, the base 74, and a vertical beam 96 extending from the top wall 76 to the base 74. The bay 47*c* is defined by the vertical beam 96, the top wall 76, the base 74, and an internal wall 98 of the shroud-securing bracket 78 at the end 82. Modules, such as RF, digital, or cable-connecting modules, may be secured within any of the bays 47*a*, 47*b*, or 47*c*. While three bays 47*a*, 47*b*, 47*c* are shown in FIG. 3, the frame 70 may include more or less bays 47.

Each shroud-securing bracket 78 includes a front face 100 having an insert passage 102 into which the keying insert 90 is retained, and two fastener through-holes (hidden from view) that may be aligned with the vertical axis X of the insert passages 102. The fastener through-holes receive and retain fasteners 104 that securely clamp the keying insert 90 into the shroud-securing bracket 78. The fasteners 104 may be standard or Phillips head screws. Thus, standard or Phillips head screwdrivers, which are well known and ubiquitous, may be used to secure the keying inserts 90 into the shroud-securing brackets 78. While two fasteners 104 are shown, more or less fasteners 104 may be used to secure the keying insert 90 into the shroud-securing bracket 78. For example, a single fastener above or below the insert passage 102 may be used to securely clamp the keying insert 90 into the shroud-securing bracket 78. Additionally, the fasteners 104 may be located at other positions that are not aligned with the vertical axis X of the insert passage 102.

Each keying insert 90 is adjustable and may include an octagonal outer body 106 having eight sides A-H. The octagonal outer body 106 defines an internal passage 108 having a rounded, smooth, cylindrical internal passage wall 110 connected to a keying feature, such as a flattened internal passage wall 112. The cylindrical internal passage wall 110 may span a radial arc of 315°, while the flattened internal passage wall 112 may span a radial arc of 45°. Each keying insert 90 may be adjusted, such as by being rotated, so that the flattened internal passage wall 112 is at a different location from sides A-H. For example, as shown in FIG. 3, the flattened internal passage wall 112 of the keying insert 90 at the end 80 is at side A, while the flattened internal passage wall 112 of the keying insert 90 at the end 82 is at side B. The different positions of the flattened internal passage walls 112 may be keyed to alignment posts 40 (shown in FIGS. 1 and 2) of a particular shroud so that only that particular, distinct shroud can mate with the module shell 32. The flattened internal passage walls 112 may be rotated or clocked to different positions in order to change the keying configuration. For example, a user may remove the fasteners 104 so that the keying inserts 90 may be removed from the insert passages 102. Once removed, the keying inserts 90 may be rotated so that the flattened internal passage walls 112 are at different positions. The keying inserts 90 are then re-inserted, and the fasteners 104 are then engaged over outer edges 120 of the keying inserts 90 in order to fasten the keying inserts 90 into the shroud-securing brackets 78.

As shown in FIG. 3, the keying inserts 90 have eight sides A-H that are retained in eight-sided reciprocal insert passages 102. Therefore, each keying insert 90 may be rotated within the insert passages 102, as discussed above, so that each flattened internal passage wall 112 is at a different side A-H. A 45° turn of a keying insert yields a different configuration. For example, the keying insert 90 at end 80 could be moved 45° from side A to side B, while the keying insert 90 at end 82 could be moved −45° from side B to side A. Sixty-four keying combinations are provided when two eight-sided keying inserts 90 are used.

Alternatively, the keying inserts 90 may be include more or less sides than eight. Accordingly, the alignment posts 40 would have a reciprocal surface, protuberance, or other such feature, such as a flattened area, that would be configured to mate with the keying feature located at one of the sides. Additionally, the keying inserts 90 may include more than one keying feature. For example, each keying insert 90 may include two or more flattened areas located at different sides (for example, a flattened internal passage wall at sides A and E, or A, C, E, and G), while the reciprocal alignment posts 40 would have the same number of reciprocal features.

Additionally, the keying inserts 90 may have different keying features other than flattened internal passage walls. For example, the keying inserts 90 may include slots, while the alignment posts 40 have tabs, or vice versa. The keying inserts 90 may be any shape or size that may key to a reciprocal feature of the alignments posts 40.

Figure 4:
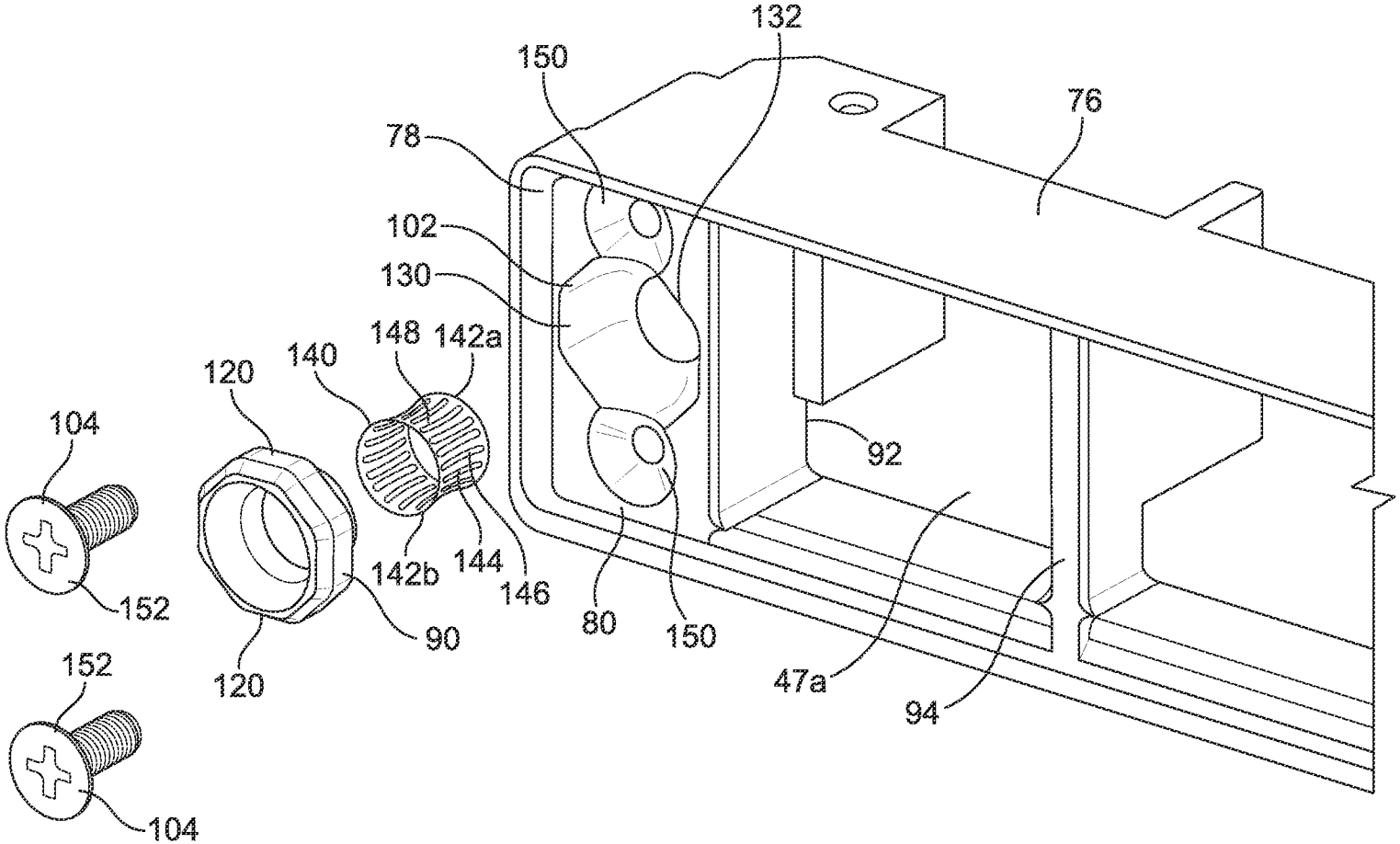
FIG. 4 illustrates an isometric exploded view of a portion of a module shell, according to an embodiment.

FIG. 4 illustrates an isometric exploded view of a portion of the module shell 32, according to an embodiment. As shown in FIG. 4, the insert passage 102 includes eight internal walls 130 that connect to a recessed passage 132, which may be defined by cylindrical internal walls. The recessed passage 132 may have an internal undercut cavity (not shown in FIG. 4).

A grounding member 140, which may be flexible and/or spring-biased, is positioned within the recessed passage 132. The grounding member 140 may be a louvered band that includes opposed annular ends 142*a* and 142*b* connected by louvered vanes 144 that generally perpendicularly connect to the annular ends 142*a* and 142*b*. The louvered vanes 144 are separated by gaps 146. The louvered vanes 144 generally inwardly bend, cant, slope, or the like from each annular end 142*a* and 142*b* toward the center 148 of the flexible member 140. The louvered vanes 144 and separating gaps 146 provide flexibility to the grounding member 140. When the grounding member 140 is inserted into the recessed passage 132, the leading opposed annular end 142*a* is compressed as it passes into the undercut cavity of the recessed passage 132. The grounding member 140 continues to pass through the undercut cavity of the recessed passage 132 until the leading annular end 142*a* snaps into the undercut cavity of the recessed passage 132, and snaps back to its at-rest position within the recessed passage 132. Similarly, the trailing annular end 142*b* is positioned at an opposite end (from the leading end 142*a*) of the undercut cavity of the internal passage 132, thereby locking the flexible member 140 in place. The louvered vanes 144 have a smaller diameter than the recessed passage 132, and therefore fit therein. For example, the louvered vanes 144 may be configured to conform to, and abut, the internal walls that define the recessed passage 132.

The grounding member 140 provides a multi-point contact system within the shroud-securing bracket 78. As described above, the grounding member 140 slides into the recessed passage 132, with the leading end 142*a* flexing or popping out so that the louvered vanes 144 are retained within the undercut cavity of the recessed passage 132. As explained below with respect to FIG. 7, the grounding member 140 provides a reliable connection to the alignment posts 40 of the shroud 16 (shown in FIGS. 1 and 2).

The grounding member 140 may be separate and distinct from the keying insert 90. Once the shell module or assembly 32 is fully assembled, the grounding member 140 may or may not directly contact the keying insert 90. For example, the grounding member 140 may be positioned within the recessed passage 132 a distance from the keying insert 90, which is retained within the insert passage 102 that leads into the recessed passage 132.

Alternatively, the grounding member 140 may not include louvered vanes, but, instead, include a contiguous flexible wall that fits inside the recessed passage.

Once the grounding member 140 is secured within the recessed passage 132, the keying insert 90 is inserted into the reciprocal insert passage 102 at a desired position (with a keying feature at a desired position). After the keying insert 90 is positioned within the insert passage 102, the fasteners 104 are aligned with the fastener through-holes 150 and secured therein. As the fasteners 104 are secured into the through-holes 150, the fastener heads 152 securely clamp to outer edges 120 of the keying insert 90, thereby securely fastening the keying insert 90 to the shroud-securing bracket 78.

Figure 5:
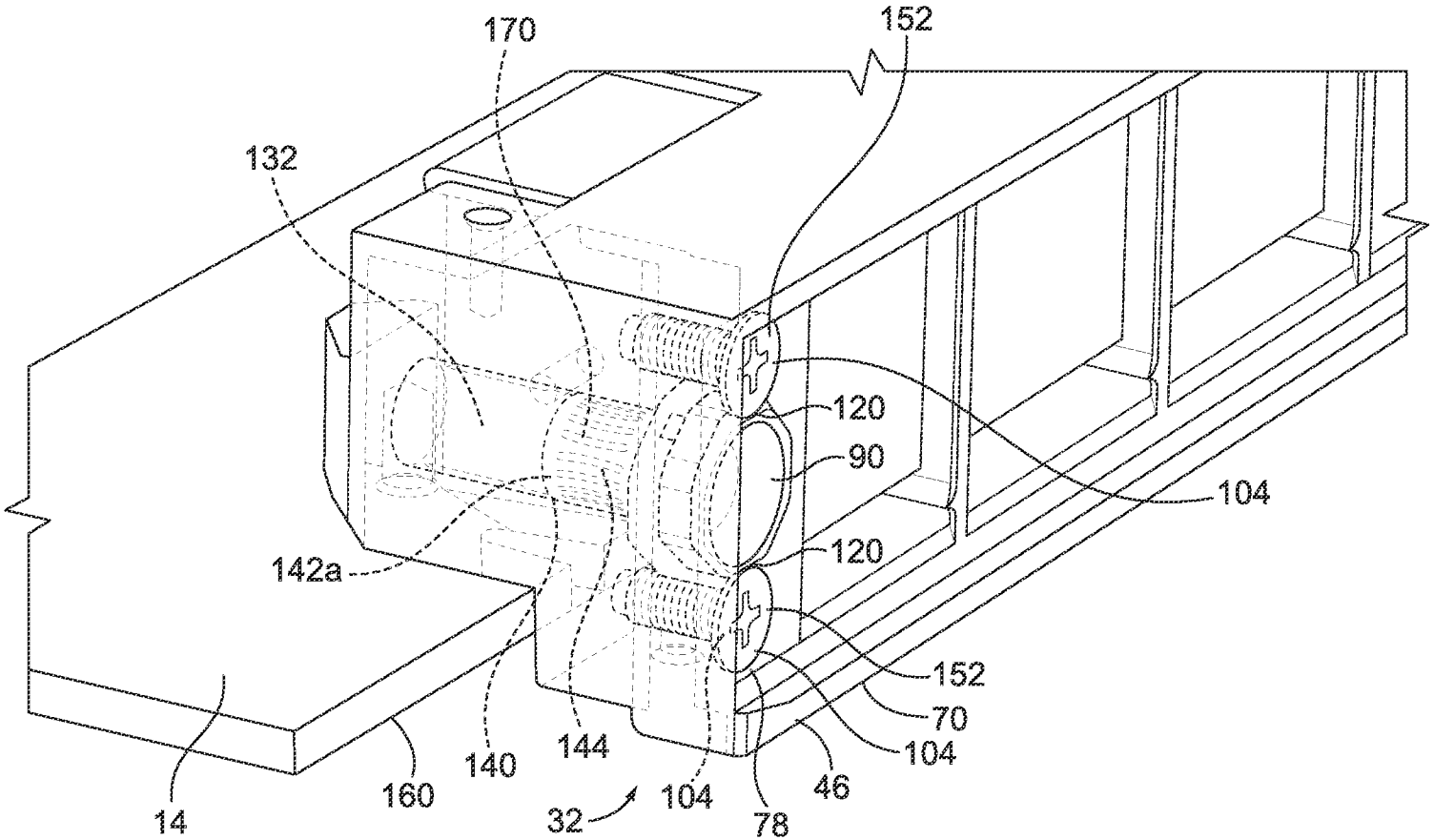
FIG. 5 illustrates an isometric, partial-internal view of a module shell secured to a daughtercard, according to an embodiment.

FIG. 5 illustrates an isometric, partial-internal view of the module shell 32 secured to the daughtercard 14, according to an embodiment. As shown in FIG. 5, the louvered vanes 144 are retained within the undercut cavity 170 of the recessed passage 132. The undercut cavity 170 has a diameter that is less than the diameter of the annular ends 142*a* and 142*b* of the grounding member 140. However, the louvered vanes 144 may conform to the shape of the undercut cavity 170. The fastener heads 152 securely clamp over outer edges 120 of the keying insert 90, thereby securely fastening the keying insert 90 to the shroud-securing bracket 78.

Figure 6:
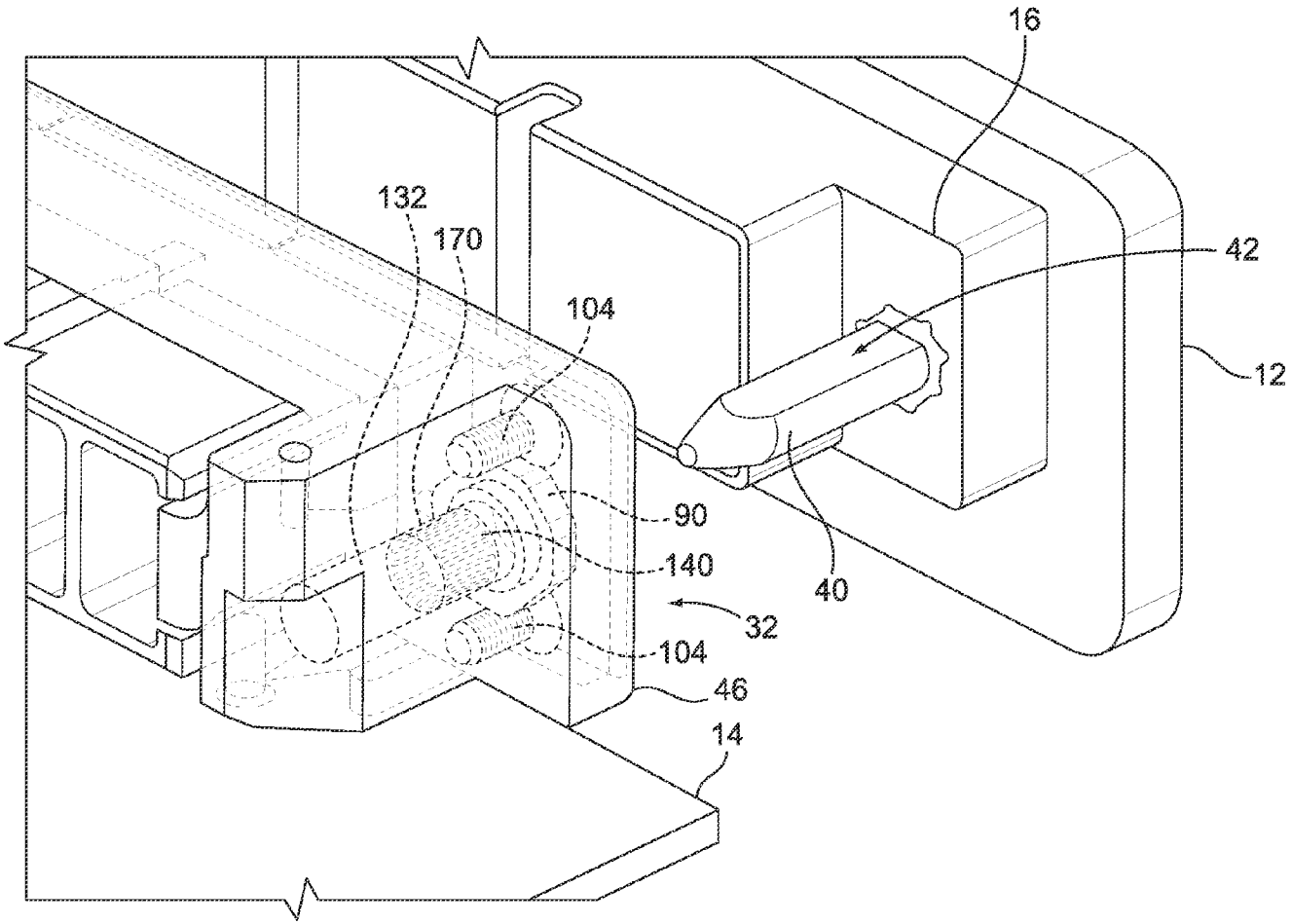
FIG. 6 illustrates an isometric view of a shroud being aligned with a module shell, according to an embodiment.

FIG. 6 illustrates an isometric view of the shroud 16 being aligned with the module shell 32, according to an embodiment. The alignment posts 40 of the shroud are aligned with the apertures 44 (shown in FIG. 1) defined by the keying inserts 90. The keying features, such as flattened internal passage walls, are configured to receive alignment posts 40 of a particular orientation. That is, the reciprocal features of the alignment posts 40, such as the flattened area 42, are aligned with the keying features of the keying inserts 90 in order for the shroud 16 to mate with the module shell 32. The dual keying inserts 90 ensure that the shroud 16 only mates with a compliant module shell 32. That is, if the shroud 16 were rotated such that the flattened area 42 was aligned with a keying feature that was not supposed to accept the shroud 16, the modules of the module shell 32 would not align with the connecting interfaces of the shroud 16. As such, the shroud 16 would not properly mechanically mate with the module shell 32. Instead, only a shroud 16 having alignment posts 40 oriented in compliance with the reciprocal keying features of the keying inserts 90 is able to electrically and mechanically mate with the module shell 32. As explained above, the keying inserts 90 may be changed in order to accept alignment posts 40 of specific shrouds 16.

Figure 7:
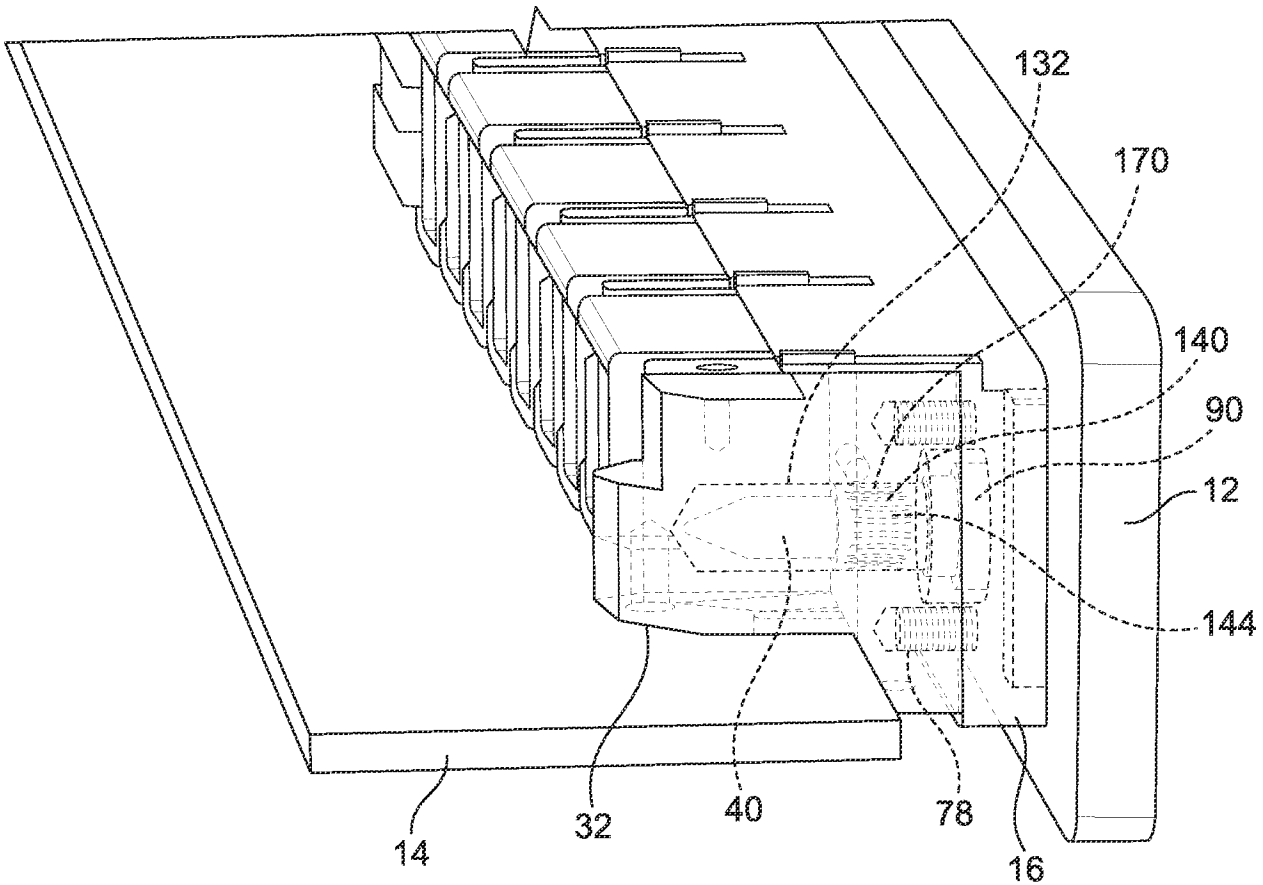
FIG. 7 illustrates an isometric, partial-internal view of a module shell mated to a shroud, according to an embodiment.

FIG. 7 illustrates an isometric, partial-internal view of the module shell 32 mated to the shroud 16, according to an embodiment. When the shroud 16 is properly mated to the module shell 32, the alignment posts 40 of the shroud 16 are retained within the recessed passages 132. The grounding members 140 contact outer surfaces of the alignment posts 40. That is, the louvered vanes 144 are configured to be compressively sandwiched between walls of the shroud-securing brackets 78 that define the undercut cavities 170 and outer walls of the shaft of the alignment posts 40. Accordingly, an electrostatic discharge, surge, or the like, from the backplane 12 or the shroud 16, for example, is transferred from the chassis to the alignment posts 40. The electrostatic discharge, surge, or the like is then transferred from the alignment posts 40, to the grounding member 140, and then to ground via the shroud-securing bracket 78. The electrostatic discharge is prevented from arcing, for example, within the module shell 32.

The keying inserts 90 may be configured to be secured to the module shell 32 using common fasteners. Thus, the keying inserts 90 may be quickly and easily secured using a common tool, such as a screwdriver. Further, the keying inserts 90 are easily removed and re-oriented through the use of the common tool.

Figure 8:
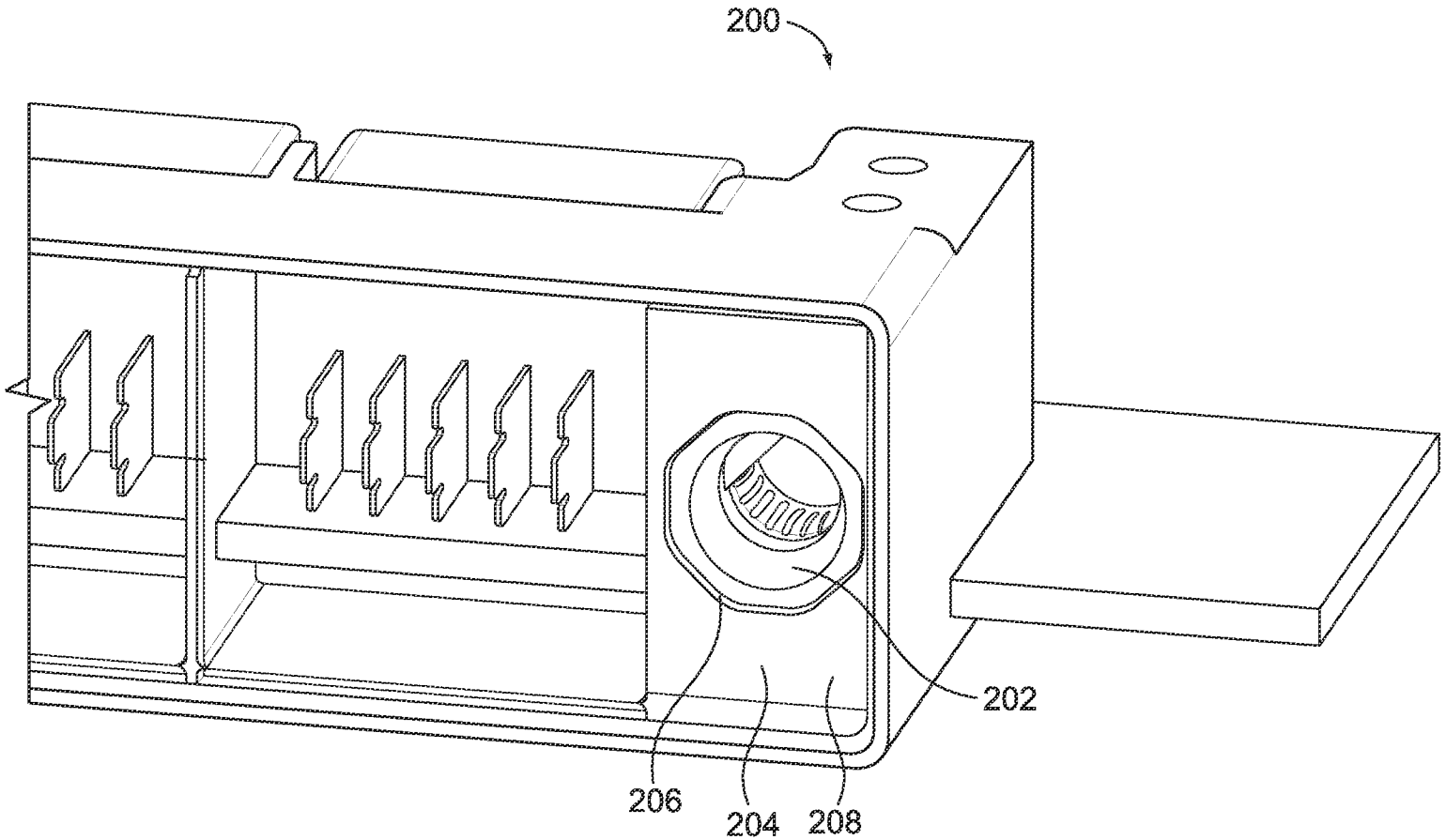
FIG. 8 illustrates an isometric front view of a module shell, according to an embodiment.

FIG. 8 illustrates an isometric front view of a module shell 200, according to an embodiment. The module shell 200 includes a keying insert 202 similar to the keying insert 90 described above, except that the keying insert 202 is snapably secured into the insert passage 206 of the shroud-securing bracket 208, instead of being secured with separate fasteners.

Figure 9:
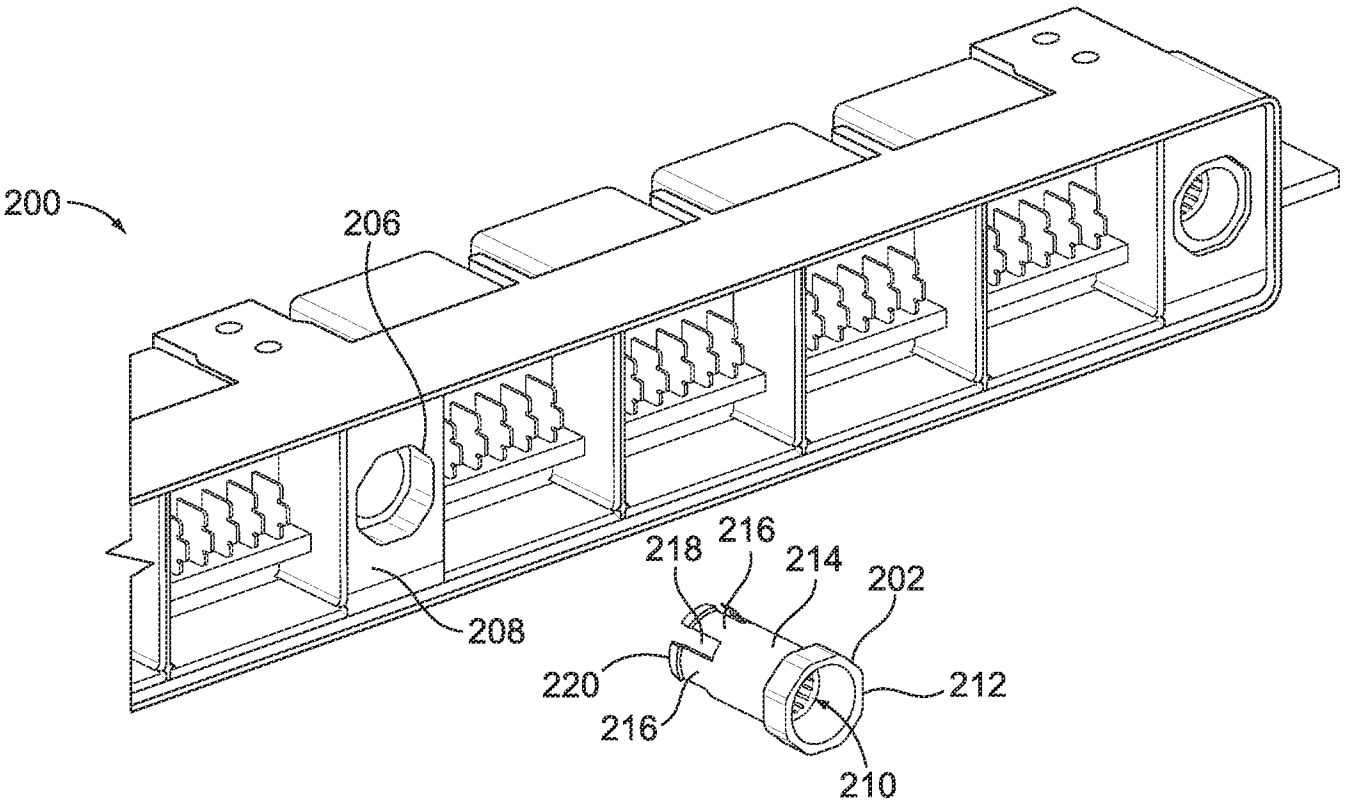
FIG. 9 illustrates an isometric front view of a module shell having a keying insert removed, according to an embodiment.

FIG. 9 illustrates an isometric front view of the module shell 200 having the keying insert 202 removed from the insert passage 206, according to an embodiment. The keying insert 202 includes an aperture 210 defined by a keying wall 212 having a keying feature (such as a flattened internal passage wall), as described above. The keying wall 212 integrally connects to a tube 214 having segments 216 separated by channels 218. A securing lip 220 is located at an opposite end of the tube 214 from the keying wall 212.

The channels 218 are formed from a distal end of the tube 214 and extend toward a center of the tube 214. The channels 218 allow the segments 216 to deflect inwardly, as the keying insert 202 is inserted into the insert passage 206.

Figure 10:
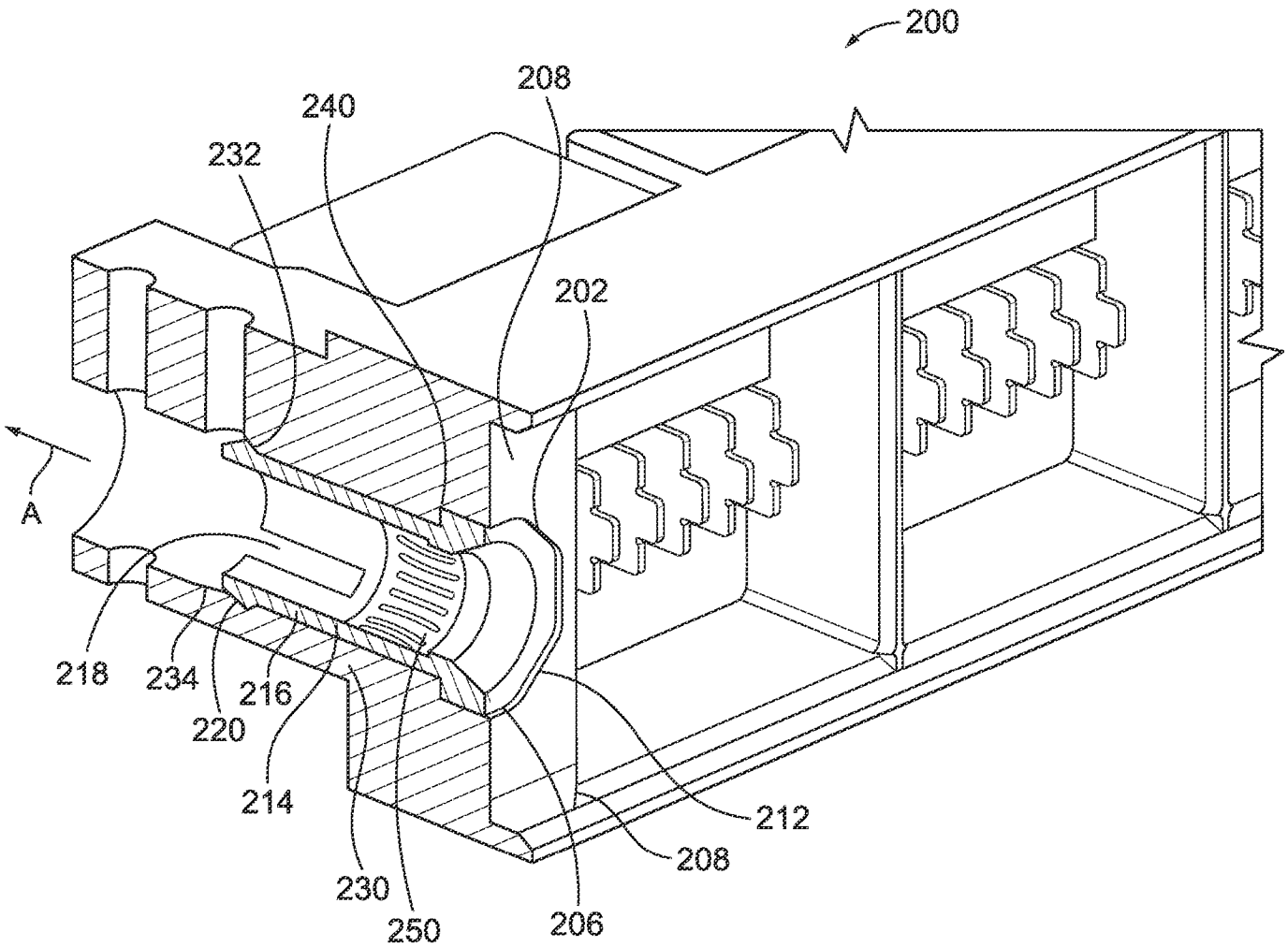
FIG. 10 illustrates an isometric, partial-internal view of a module shell, according to an embodiment.

FIG. 10 illustrates an isometric, partial-internal view of the module shell 200, according to an embodiment. As shown in FIG. 10, as the securing lip 220 is inserted into the insert passage 206 and urged in the direction of arrow A, the segments 216 deflect inwardly. As the keying insert 202 continues to pass into the insert passage 206, the securing lip 220 slides past a reduced-diameter portion 230 of the insert passage 206 and snapably secures to a ledge 232 of an expanded diameter portion 234 of the insert passage 206, thereby lodging the keying insert in place. The keying insert 202 is prevented from passing further into the insert passage 206 in the direction of arrow A by the keying wall 212 abutting against a front wall 240 within the shroud-securing bracket 208. That is, the shroud-securing bracket 208 has a diameter greater than the diameter of the reduced-diameter portion 230 of the insert passage 206.

A grounding member 250, similar to the grounding member 140 described above, is retained within the tube 214. The grounding member 250 is within the tube 214 of the keying insert 202. The grounding member 250 may be integrally formed with the keying insert 202. The grounding member 250 may have louvered vanes, as described above. The grounding member 250 is configured to contact an alignment post of a shroud, as described above, to short any electrostatic discharge to ground.

In order to remove the keying insert 202, a tool is used to squeeze the segments 216 together so that they may pass into the reduced-diameter portion 230 of the insert passage 206, and the keying insert 202 is then pushed or pulled out of the insert passage 206.

Thus, the keying insert 202 eliminates the need for separate fasteners. As such, the module shell 200 may be manufactured using less components, as compared to those that use separate and distinct fasteners.

Referring to FIGS. 1-10, embodiments provide a module shell that may be simply and easily re-configured and re-oriented to mate with specific connector shrouds. Additionally, embodiments provide a module shell having keying inserts that provide a positive electrical conductive path for electrostatic discharge. Also, embodiments provide a module shell having keying inserts that are simply and reliably secured thereto.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An assembly configured to retain a plurality of electrical modules, wherein the assembly is configured to mate with a shroud having a plurality of connecting interfaces configured to mate with the plurality of electrical modules, the assembly comprising:

a frame having at least one shroud-securing bracket and at least one bay configured to retain at least one of the plurality of electrical modules;

at least one keying insert retained within at least one insert passage of the at least one shroud-securing bracket, the at least one keying insert comprising at least one adjustable keying feature that is configured to be adjusted to different positions in order to accommodate a reciprocal alignment post of the shroud, wherein the at least one keying insert is adjusted by rotating the at least one keying insert relative to the shroud-securing bracket; and at least one grounding member secured within the at least one keying insert, wherein the at least one grounding member is configured to direct electrostatic discharge from the shroud to ground, wherein the at least one grounding member comprises opposed annular ends integrally connected to louvered vanes, wherein the louvered vanes curve inwardly toward a center of the at least one grounding member.

2. The assembly of claim 1, wherein the at least one keying insert comprises an outer body having a cylindrical internal passage connected to the at least one adjustable keying feature.

3. The assembly of claim 2, wherein the at least one adjustable keying feature comprises a flattened internal passage wall.

4. The assembly of claim 2, wherein the outer body comprises an octagonal outer body.

5. The assembly of claim 1, further comprising at least one fastener that secures the at least one keying insert to the at least one shroud-securing bracket.

6. The assembly of claim 1, wherein the at least one keying insert is snapably secured within the at least one insert passage.

7. The assembly of claim 6, wherein the at least one keying insert comprises a tube having deflectable segments configured to snapably secure within the at least one insert passage.

8. The assembly of claim 1, wherein the at least one grounding member is separate and distinct from the at least one keying insert.

9. An assembly configured to retain a plurality of electrical modules, wherein the assembly is configured to mate with a shroud having a plurality of connecting interfaces configured to mate with the plurality of electrical modules, the assembly comprising:

a frame having at least one shroud-securing bracket and at least one bay configured to retain at least one of the plurality of electrical modules;

at least one keying insert retained within at least one insert passage of the at least one shroud-securing bracket, the at least one keying insert comprising at least one adjustable keying feature that is configured to be adjusted to different positions in order to accommodate a reciprocal alignment post of the shroud; and at least one grounding member secured within the at least one shroud-securing bracket, wherein the at least one grounding member comprises opposed annular ends integrally connected to louvered vanes, wherein the louvered vanes curve inwardly toward a center of the at least one grounding member, and wherein the at least one grounding member is configured to direct electrostatic discharge from the shroud to ground.

* * * * *